US008714694B2

(12) United States Patent
Kobayashi

(10) Patent No.: US 8,714,694 B2
(45) Date of Patent: May 6, 2014

(54) IMAGE RECORDING APPARATUS

(75) Inventor: Akihito Kobayashi, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 167 days.

(21) Appl. No.: 13/033,148

(22) Filed: Feb. 23, 2011

(65) Prior Publication Data

US 2011/0216121 A1 Sep. 8, 2011

(30) Foreign Application Priority Data

Mar. 8, 2010 (JP) ..... 2010-050998

(51) Int. Cl.
*B41J 2/015* (2006.01)
*B41J 2/175* (2006.01)

(52) U.S. Cl.
CPC ..... *B41J 2/1752* (2013.01); *B41J 2/17513* (2013.01); *B41J 2/17553* (2013.01)
USPC ..... 347/20; 347/84; 347/85

(58) Field of Classification Search
CPC .... B41J 2/1623; B41J 2/1631; B41J 2/14024; B41J 2/1628; B41J 2/1603; B41J 2/1752; B41J 2/17509; B41J 2/17513; B41J 2/17553; B41J 3/36; B41J 29/13
USPC ..... 347/20, 37, 50, 84, 85, 86, 89, 108, 347/109, 152
IPC ..... B41J 2/015
See application file for complete search history.

(56) References Cited

U.S. PATENT DOCUMENTS

2002/0126180 A1 9/2002 Hiramatsu et al.
2003/0107624 A1 6/2003 Koga
2003/0132987 A1* 7/2003 Ogawa ..... 347/58
2004/0212665 A1 10/2004 Koga
2007/0070137 A1 3/2007 Hattori et al.
2007/0146445 A1* 6/2007 Nukui et al. ..... 347/85
2007/0229582 A1 10/2007 Yano
2009/0167834 A1* 7/2009 Kuriki ..... 347/108

FOREIGN PATENT DOCUMENTS

| | | |
|---|---|---|
| JP | S61-083044 | 4/1986 |
| JP | 2002/321351 | 11/2002 |
| JP | 2003/175588 | 6/2003 |
| JP | 2004/291246 | 10/2004 |
| JP | 2007/090733 | 4/2007 |
| JP | 2007/145032 | 6/2007 |
| JP | 2007/268979 | 10/2007 |

OTHER PUBLICATIONS

Notice of Reasons for Rejection of Japanese Patent Application No. 2010-050998 dated Jul. 24, 2012.

* cited by examiner

*Primary Examiner* — Manish S Shah
*Assistant Examiner* — Roger W Pisha, II
(74) *Attorney, Agent, or Firm* — Frommer Lawrence & Haug LLP

(57) ABSTRACT

There is provided an image recording apparatus including: a recording head; an ink storage section; a tube having one end thereof connected to the ink storage section; a channel member having an ink channel that communicates with the recording head formed therein; a joint connecting the other end of the tube and the ink channel in the channel member; a circuit board mounted on the recording head; and a cable electrically connected to the circuit board. The channel member, the cable, and the tube are disposed in this order from a lower side to an upper side in a vertical direction.

7 Claims, 8 Drawing Sheets

IMAGE RECORDING APPARATUS

CROSS REFERENCE TO RELATED APPLICATION

The present application claims priority from Japanese Patent Application No. 2010-050998, filed on Mar. 8, 2010, the disclosure of which is incorporated herein by reference in its entirety.

BACKGROUND OF THE INVENTION

1. Field of the Invention

The present invention relates to an image recording apparatus formed in a manner that a tube and a cable are connected to a recording head.

2. Description of the Related Art

There has been known an image recording apparatus in an ink jet method that records an image on a recording medium by jetting ink onto the recording medium based on an input signal. As for the ink jet method, there have been known a method of guiding ink to an actuator such as a piezoelectric element or an electrostrictive element provided in a recording head and jetting an ink droplet from a nozzle by bend of the actuator in accordance with an input signal, and a method of pressurizing and jetting an ink droplet by using local boiling of ink by a heat generating element.

A recording head in the ink jet method is mounted on, for example, a carriage to reciprocate in a constant direction across a recording medium such as a recording paper. A driving force is transmitted to the carriage from a drive source such as a motor, and the carriage is guided by a guide shaft and a guide rail to thereby reciprocate in the constant direction. In the above reciprocation of the carriage, ink droplets are selectively jetted onto the recording medium from the recording head and an image is recorded by the ink droplets that land on the recording medium.

Ink is supplied to the recording head from an ink cartridge or the like, and as a method of supplying ink in the above, a method to use a tube exists. The tube is a channel for making ink flow to the recording head from an ink cartridge provided at a position different from the recording head, and has sufficient flexibility in order to follow the reciprocation of the carriage.

Further, in the carriage, a control board controlling the operation of the recording head is provided. The above control board is operated based on a signal to be output from a main board provided in the image recording apparatus. The control board and the main board are connected by a flexible•flat•cable (FFC) to enable an electric signal to be transmitted/received therebetween. The above FFC also has sufficient flexibility in order to follow the reciprocation of the carriage.

There is sometimes a case that in the image recording apparatus, test printing is performed at the time of the image recording apparatus being manufactured or before shipment. In the test printing, ink is supplied to the recording head through the tube and a test pattern is practically printed on a recording paper. After the test printing, a dummy ink cartridge is installed in the image recording apparatus so that the ink does not leak from the tube after shipment.

The previously described dummy ink cartridge is hardly necessary to be used after an ink cartridge having ink stored therein is practically installed in the image recording apparatus and the image recording apparatus is started to be used. Thus, a user often discards the dummy ink cartridge after starting to use the image recording apparatus. Such a part to be discarded probably results in a waste of resources or an environmental impact, so that such a part is desirably reduced as much as possible. Further, even though the ink used for the test printing remains in the tube, when the user starts to use the image recording apparatus, there is a high possibility that the ink remaining in the tube already deteriorates. Thus, when the user starts to use the image recording apparatus, the ink remaining in the tube is discarded. In order to reduce the environmental impact, it is also desirable to reduce an amount of discarded ink as above as much as possible.

SUMMARY OF THE INVENTION

The present invention has been made in consideration of the above circumstances, and has an object to provide an image recording apparatus in which wastes such as a dummy ink cartridge and discarded ink to be an environmental impact can be reduced as much as possible and ink leakage from a tube can be reduced after test printing, and a test printing method in such an image recording apparatus.

According to an aspect of the present invention, there is provided an image recording apparatus which jets droplets of an ink onto a recording medium, including:

a recording head having a plurality of nozzles through which the ink droplets are jetted;

an ink storage section which stores the ink;

a tube of which one end is connected to the ink storage section and through which the ink to be supplied to the recording head from the ink storage section flows;

a channel member in which an ink channel that communicates with the recording head is formed;

a joint which is detachably attached to the channel member which connects the other end of the tube and the ink channel of the channel member to flow the ink therebetween;

a circuit board which is mounted on the recording head; and a cable which is extended from the carriage and electrically connected to the circuit board, wherein the channel member, the cable, and the tube are disposed in an order of the channel member, the cable, and the tube from a lower side to an upper side in a vertical direction.

The ink is supplied to the recording head from the ink storage section through the tube and the channel member. The operation of the recording head is controlled by the circuit board. An electric signal is transmitted to/from the above circuit board through the cable. The ink droplets are selectively jetted from the recording head at a predetermined timing when the carriage reciprocates. The ink droplets land on the recording medium, and thereby an image is recorded on the recording medium.

In order to remove ink retained in the tube after test printing in the image recording apparatus, the tube is pulled out from the joint and the other end of the tube that is pulled out is held on an upper side in a vertical direction, and thereby the ink in the tube may be returned to the ink storage section due to a head difference between the ink storage section and the tube. The tube is disposed on an upper side of the cable, so that when the tube is detached from the joint from the upper side in the vertical direction, the cable is not required to be detached from the carriage.

Other objects, features, and advantages of embodiments of the present invention will be apparent to persons of ordinary skill in the art from the following description of preferred embodiments with reference to the accompanying drawings.

DETAILED DESCRIPTION OF THE PREFERRED EMBODIMENTS

Hereinafter, an embodiment of the present teaching will be explained with reference to the drawings as appropriate. Incidentally, the embodiment to be explained below is merely one example where the present teaching is embodied, and it goes without saying that the embodiment can be changed as appropriate without changing the scope of the present teaching.

<Schematic Structure of a Multifunction Machine 10>

Figure 1:
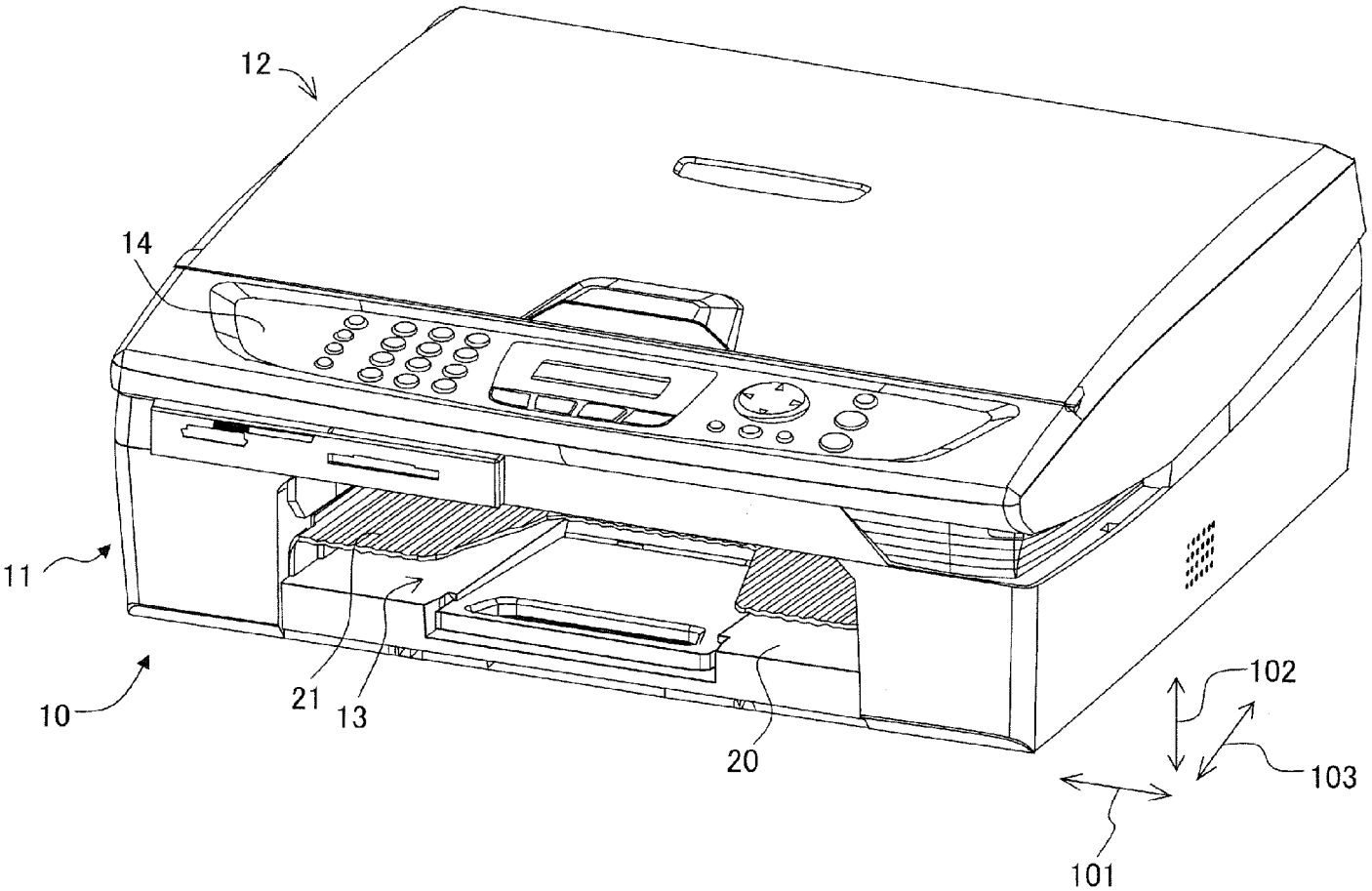
FIG. 1 is a perspective view showing an external structure of a multifunction machine 10 according to an embodiment of the present invention.
Figure 2:
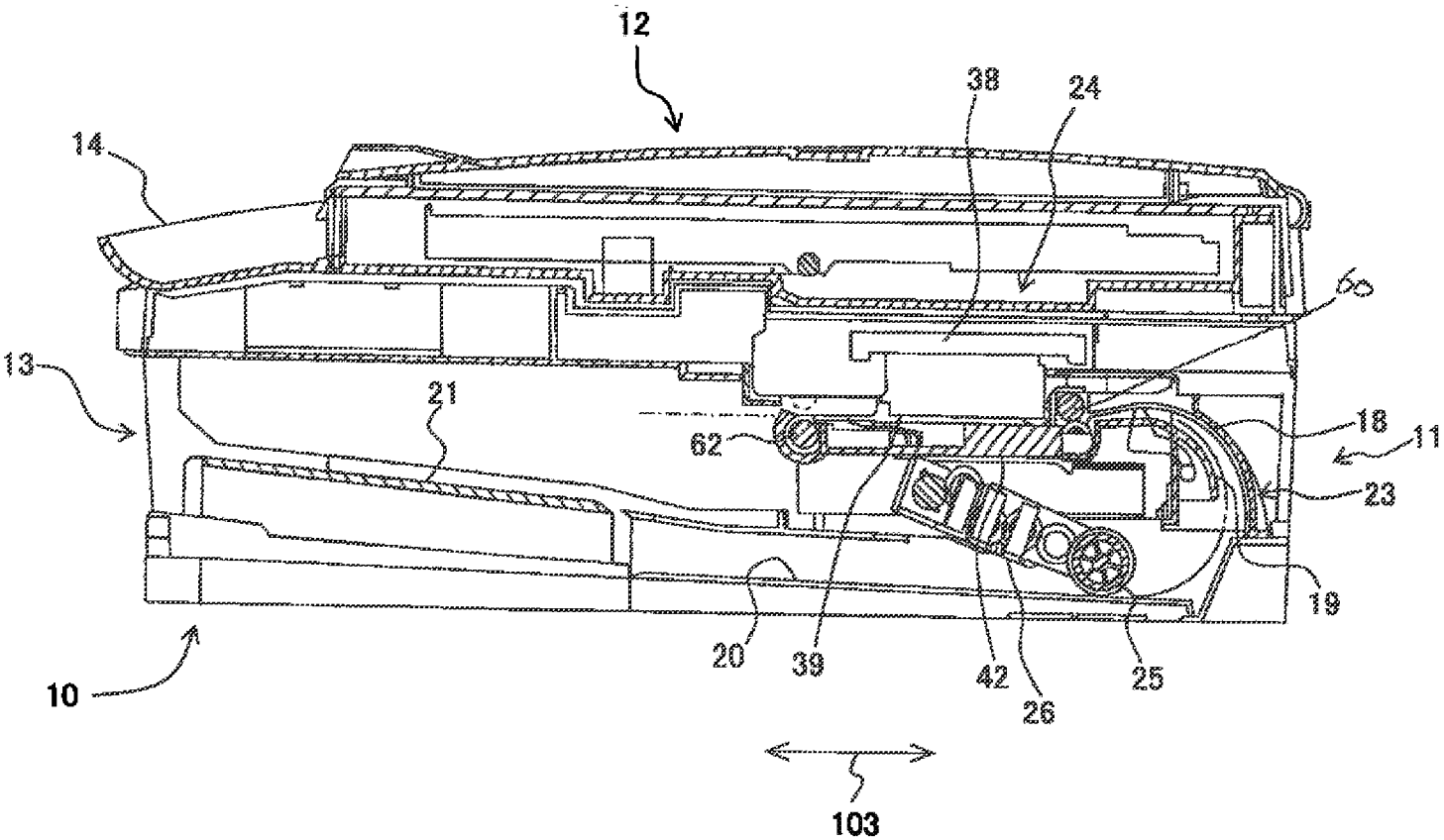
FIG. 2 is a vertical sectional view showing an internal structure of the multifunction machine 10.

As shown in FIGS. 1 and 2, the multifunction machine 10 is integrally provided with a printer section 11 and a scanner section 12, and has a print function, a scan function, a copy function, and a facsimile function. The printer section 11 corresponds to an image recording apparatus according to the present teaching. Incidentally, the functions other than that of the printer section 11 are arbitrary, and the image recording apparatus according to the present teaching may also be implemented as a single function printer without, for example, the scanner section 12, which does not have the scan function and the copy function.

In the multifunction machine 10, the printer section 11 is disposed on a lower side, and the scanner section 12 is disposed on an upper side. The printer section 11 is connected to an external information device such as a computer and records an image and a letter to a recording medium based on print data including image data and text data that are transmitted from the external information device. The scanner section 12 is what is called a flatbed scanner.

The multifunction machine 10 has a substantially wide and thin rectangular parallelepiped outer shape whose dimensions in a width direction 101 and a depth direction 103 are larger than that in a height direction 102. The printer section 11 has an opening 13 provided in a front surface. A paper feeding tray 20 and a paper discharge tray 21 are provided inside the opening 13. A recording paper housed in the paper feeding tray 20 is fed into the inside of the printer section 11 to have a desired image recorded thereon, and the recording paper on which the image is recorded is discharged to the paper discharge tray 21.

An operation panel 14 is provided on a front upper portion of the multifunction machine 10. On the operation panel 14, predetermined inputs for making the printer section 11 and the scanner section 12 perform desired operations are performed. The operation panel 14 has a plurality of buttons for performing the inputs and a display for displaying a state, errors, and so on of the multifunction machine 10 thereon. Incidentally, in the case when the external information device is connected to the multifunction machine 10, the multifunction machine 10 operates also based on instructions to be transmitted from the external information device through communication software such as a printer driver and a scanner driver.

<Printer Section 11>

As shown in FIG. 2, the paper feeding tray 20 is provided on the lowest side of the multifunction machine 10. The paper discharge tray 21 is disposed to be superimposed over an upper side of the paper feeding tray 20. The paper feeding tray 20 and the paper discharge tray 21 are connected by a paper transporting path 23, and a recording medium such as the recording paper is transported to the paper discharge tray 21 from the paper feeding tray 20 through the paper transporting path 23. The recording paper housed in the paper feeding tray 20 is guided to make a U-turn from a lower place to an upper place by the paper transporting path 23 and is transported to an image recording unit 24, and an image is recorded on the recording paper by the image recording unit 24 and thereafter the recording paper is discharged to the paper discharge tray 21.

The paper feeding tray 20 has a container shape of which upper side is opened, and in an inner space thereof, sheet-shaped recording media such as the recording papers are housed in a state of being stacked. In the paper feeding tray 20, recording papers in various sizes that are not larger than an A3 size such as, for example, an A4 size, a B5 size, and a postcard size can be housed.

The paper discharge tray 21 has a tray shape, and the recording paper is discharged onto an upper surface of the paper discharge tray 21. The paper discharge tray 21 is disposed at a front side of the apparatus (an apparatus-front side) than the front of the paper feeding tray 20 in the depth direction 103. Thus, the paper discharge tray 21 is not provided above the paper feeding tray 20 at a rear side or a far side of the apparatus (an apparatus-rear side).

A paper feeding roller 25 is provided at the apparatus-rear side of the paper feeding tray 20. The paper feeding roller 25 supplies the recording paper stacked in the paper feeding tray 20 to the paper transporting path 23. The driving force is transmitted to the paper feeding roller 25 from a not-illustrated motor to rotate the paper feeding roller 25. The paper feeding roller 25 is rotatably supported to a tip of a paper feeding arm 26. The paper feeding arm 26 is formed to be able to pivot, and a paper feeding roller 25 side is set as a pivot tip side. In other words, the paper feeding arm 26 can pivot about an end portion of the paper feeding arm 26 that is opposite to the paper feeding roller 25 as a pivot shaft. By the pivot, the paper feeding roller 25 moves up and down in such a direction as to approach/go away from the paper feeding tray 20. The paper feeding arm 26 is biased by a weight, a spring, or the like of the paper feeding roller 25 to pivot downward, and moves upward in accordance with an amount of the recording papers housed in the paper feeding tray 20. Thereby, the paper feeding roller 25 comes into contact with the recording paper positioned uppermost in the paper feeding tray 20. When the paper feeding roller 25 is rotated in such a state, the recording paper positioned uppermost is sent to the paper transporting path 23 by a frictional force between a roller surface of the paper feeding roller 25 and the recording paper.

The paper transporting path 23 extends upward from the paper feeding tray 20 at the apparatus-rear side and then curves toward the apparatus-front side and extends from the apparatus-rear side of the multifunction machine 10 to the apparatus-front side thereof along the depth direction 103 and leads to the paper discharge tray 21 through the image recording unit 24. A portion, of the paper transporting path 23, other than portions where the image recording unit 24 and the like are provided is demarcated by an outer guide surface and an inner guide surface that face each other at a predetermined interval. For example, the portion, of the paper transporting path 23, curved at the apparatus-rear side is demarcated by an outer guide member 18 and an inner guide member 19 that are fixed to an apparatus frame or the like.

The image recording unit 24 is mainly formed in a manner that a recording head 39 mounted on a carriage 38 and a platen 42 are disposed to face each other at a predetermined interval. The detailed structure of the image recording unit 24 will be described later.

On an upstream side from the image recording unit 24 in a transporting direction. a pair of transporting roller 60 and pinch roller are provided. Incidentally, in FIG. 2, the pinch roller is hidden by another member and is not shown, but the pinch roller is disposed on a lower side of the transporting roller 60 in a pressure contact state. The driving force is transmitted to the transporting roller 60 from a not-illustrated motor to rotate the transporting roller 60. The transporting roller 60 and the pinch roller sandwich the recording paper being transported through the paper transporting path 23 to transport it onto the platen 42.

A pair of paper discharge roller 62 and spur arc provided on a downstream side from the image recording unit 24 in the transporting direction. Incidentally, in FIG. 2, the spur is hidden by another member and is not shown, but the spur is disposed on an upper side of the paper discharge roller 62 in a pressure contact state. The driving force is transmitted to the paper discharge roller 62 from a not-illustrated motor to rotate the paper discharge roller 62. The paper discharge roller 62 and the spur sandwich the recorded recording paper to transport it to the paper discharge tray 21.

<Schematic Structure of the Image Recording Unit 24>

Figure 3:
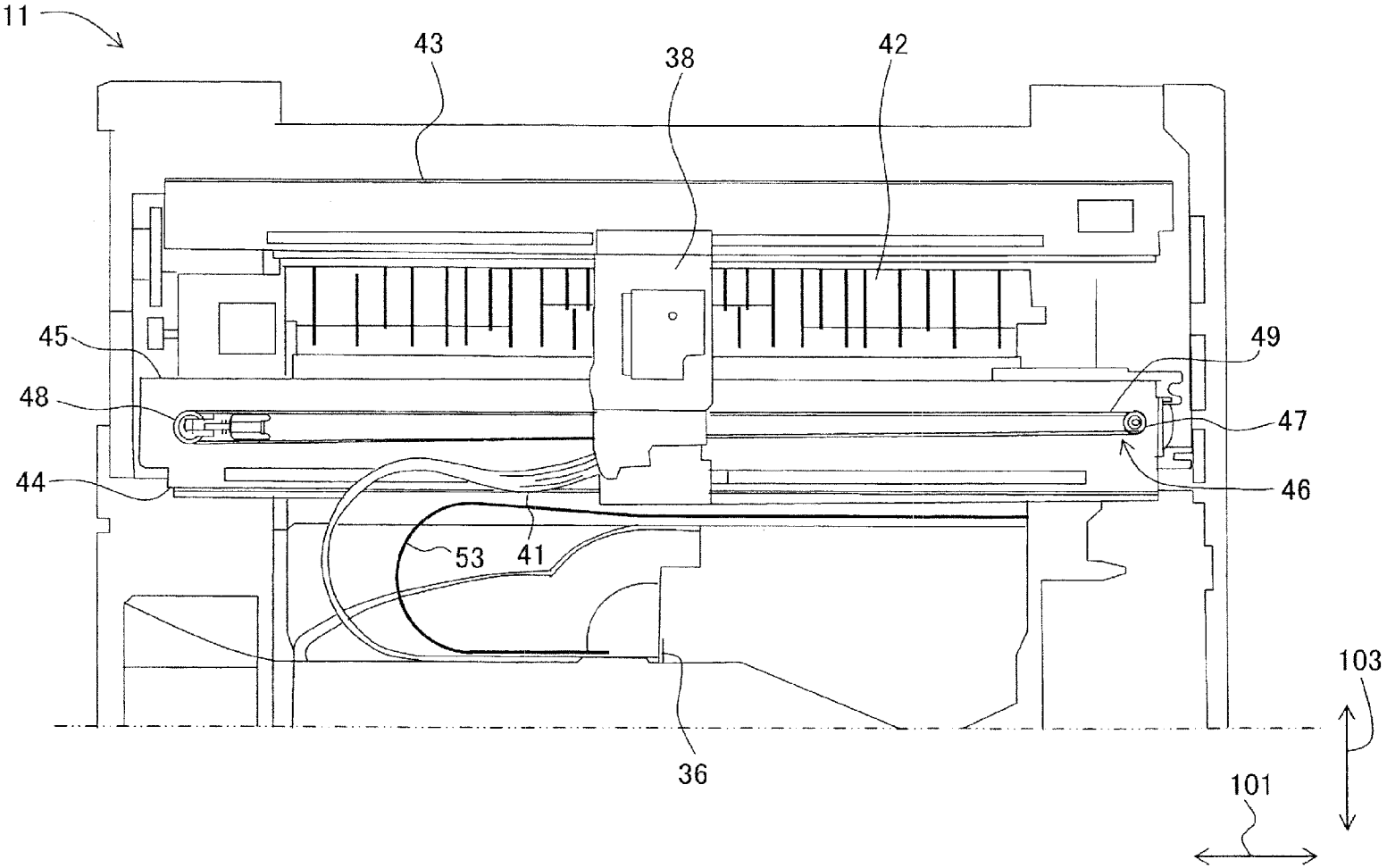
FIG. 3 is a plane view showing an internal structure of a printer section 11.

As shown in FIG. 2, the carriage 38 has the recording head 39 of the ink jet type mounted thereon. As shown in FIG. 3, respective color ink of cyan (C), •magenta (M), •yellow (Y)• and black (Bk) are supplied to the recording head 39 from ink cartridges disposed independently of the recording head 39 in the multifunction machine 10 through ink tubes 41. While the carriage 38 is reciprocating, an image is recorded on the recording paper transported on the platen 42 by selectively jetting the respective color ink onto the recording paper from nozzles of the recording head 39 as fine ink droplets. Incidentally, in FIG. 3, the ink cartridges in which the color ink of plurality of colors is stored respectively are not illustrated, but the ink cartridges correspond to ink storage sections in the present teaching. Further, the ink tubes 41 correspond to tubes in the present teaching.

As shown in FIG. 3, a pair of guide rails 43, 44 are provided to extend in an intersecting direction intersecting with the transporting direction of the recording paper (a left-right direction in FIG. 3, the width direction 101). The pair of guide rails 43, 44 are disposed at a predetermined distance on an upper side of the paper transporting path 23 in the transporting direction of the recording paper (in a direction from an upper side to a lower side in FIG. 3). The guide rails 43, 44 are provided in a casing of the printer section 11, and form a part of a frame supporting respective members forming the printer section 11. The carriage 38 is placed to straddle the guide rails 43, 44, and can slide in an extending direction of the guide rails 43, 44 (the left-right direction in FIG. 3, the width direction 101). The width direction 101 corresponds to a first direction in the present teaching.

An edge portion 45 of the guide rail 44 on an upstream side in the transporting direction is bent upward substantially perpendicularly. The carriage 38 supported by the guide rails 43, 44 slidably sandwiches the edge portion 45 with a sandwiching member equivalent to a roller. Thereby, the carriage 38 is positioned across the transporting direction of the recording paper (the direction from the upper side to the lower side in FIG. 3, the depth direction 103), and becomes slidable in the intersecting direction intersecting with (perpendicular to, in this embodiment) the transporting direction of the recording paper. That is, the carriage 38 is slidably supported on the guide rails 43, 44, and reciprocates in the intersecting direction intersecting with the transporting direction of the recording paper based on the edge portion 45 of the guide rail 44.

A belt drive mechanism 46 is provided on an upper surface of the guide rail 44. The belt drive mechanism 46 has a drive pulley 47 and a driven pulley 48 that are provided in the vicinities of both ends of the paper transporting path 23 in the width direction 101 respectively and an endless annular timing belt 49 that is stretched between the drive pulley 47 and the driven pulley 48 and has teeth provided on an inner surface thereof. A driving force is input to a shaft of the drive pulley 47 from a not-illustrated motor. By rotation of the drive pulley 47, the timing belt 49 moves around the drive pulley 47 and the driven pulley 48.

The carriage 38 is coupled to the timing belt 49 on a bottom surface side of the carriage 38, which is not shown in FIG. 3. When the timing belt 49 moves around the drive pulley 47 and the driven pulley 48, the carriage 38 reciprocates on the guide rails 43, 44 based on the edge portion 45 as a reference. The recording head 39 mounted on the carriage 38 also reciprocates in the width direction 101 of the paper transporting path 23 together with the carriage 38.

On a lower side of the paper transporting path 23, the platen 42 is provided to face the recording head 39. The platen 42 is provided to overlap a center portion through which the recording paper passes within a range where the carriage 38 reciprocates. A width of the platen 42 is sufficiently wider than a maximum width of the recording paper usable in the printer section 11. The recording paper is supported on an upper surface of the platen 42 so that a distance to the recording head 39 is maintained constantly. The ink droplets jetted from the recording head 39 land on the above recording paper.

The ink cartridges in which the color inks are stored respectively are installed in the cartridge installing section of the printer section 11, which is not shown in FIG. 3. The four ink tubes 41 corresponding to the respective color inks are routed from the cartridge installing section to the carriages 38. The ink tubes 41 routed to the carriages 38 supply the respective color inks to the recording head 39 mounted on the carriage 38. The ink tubes 41 follow the reciprocation of the carriage 38 and postures thereof change.

As shown in FIG. 3, the ink tubes 41 and a FFC 53 are fixed to a clip 36 and each extend to the carriage 38. The FFC 53 is one through which an electric signal is transmitted between a control board of the multifunction machine 10 and a head control board 52 (a circuit board) of the recording head 39. Incidentally, the control board is disposed at the apparatus-front side at the front of the clip 36, which is not shown in each of the drawings. The FFC 53 is a thin belt-shaped one in which a plurality of lead wires through which electric signals are transmitted are covered with a synthetic resin film such as a polyester film to be insulated.

The FFC 53 has sufficient flexibility in order to bend in accordance with the reciprocation of the carriage 38. One end side of the FFC 53 fixed to the carriage 38 is electrically connected to the head control board 52 mounted in the carriage 38. The other end side of the FFC 53 fixed to the clip 36 further extends to be electrically connected to the control board. A portion, of the FFC 53, bent in a substantially U-shape is not fixed to any member. Thus, a posture of the FFC 53 changes in accordance with the reciprocation of the carriage 38 similarly to the ink tubes 41.

<Carriage 38>

Figure 4:
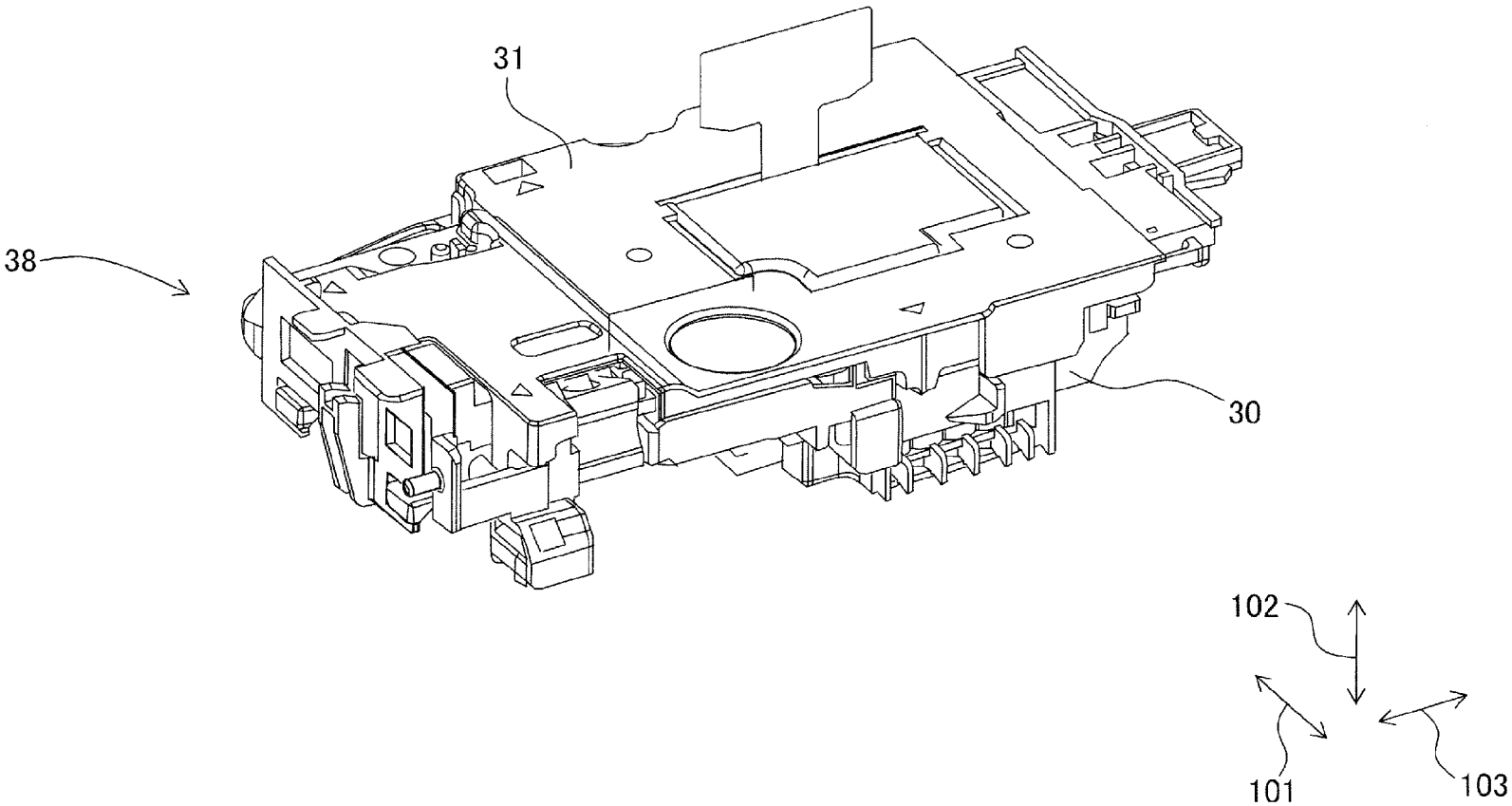
FIG. 4 is a perspective view showing an external structure of a carriage 38.
Figure 5:
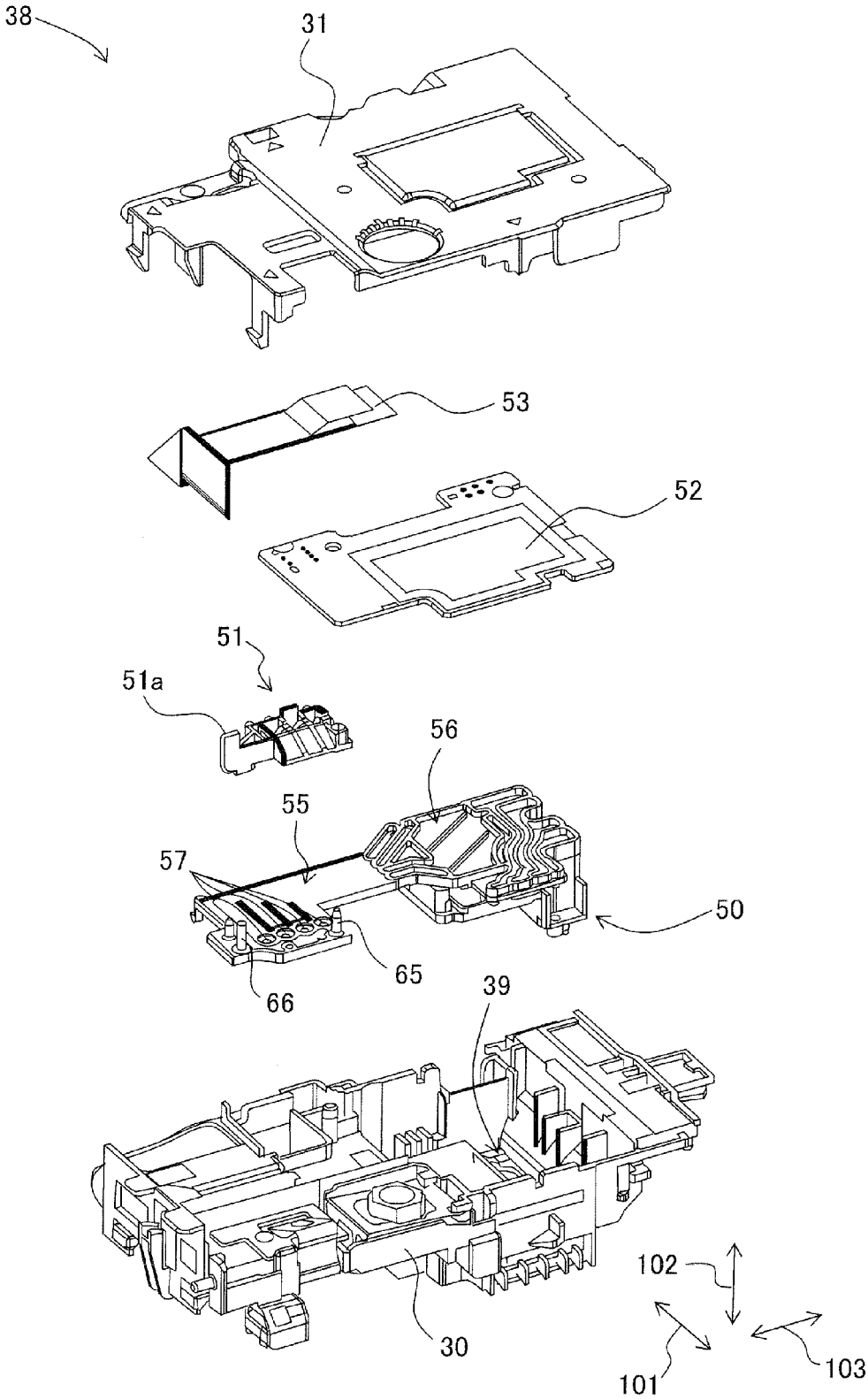
FIG. 5 is an exploded perspective view showing each member to be mounted in the carriage 38.

As shown in FIGS. 4 and 5, the carriage 38 has a carriage body 30 holding the recording head 39, a channel member 50, a joint 51, the head control board 52, and the FFC 53 therein and a cover 31 covering the carriage body 30 from an upper side. The carriage body 30 has a substantially rectangular parallelepiped shape with an upper side opened. The cover 31 can be assembled to cover the opening of the carriage body 30. The recording head 39, the channel member 50, the joint 51, the head control board 52, and the FFC 53 are housed in an inner space of the carriage body 30. Incidentally, in FIG. 5, a state where the recording head 39 is housed in the inner space of the carriage body 30 is shown. Further, in the description of the present specification, the direction from "the upper side" to "the lower side" is defined so that a direction in which gravity is applied becomes downward.

In the carriage body 30, the channel member 50 is disposed on an upper side of the recording head 39. The channel member 50 has mainly a channel section 55 forming a channel and a tank section 56 storing the inks therein. The channel section 55 has a thin flat plate shape. In the channel section 55, four lead-in ports 57 into which the respective color inks are led are aligned. The lead-in ports 57 are each formed in the channel section 55 to have an upper side thereof opened. Further, the respective lead-in ports 57 are arranged along the depth direction 103 perpendicular to the width direction 101 in which the carriage 38 reciprocates.

Figure 7:
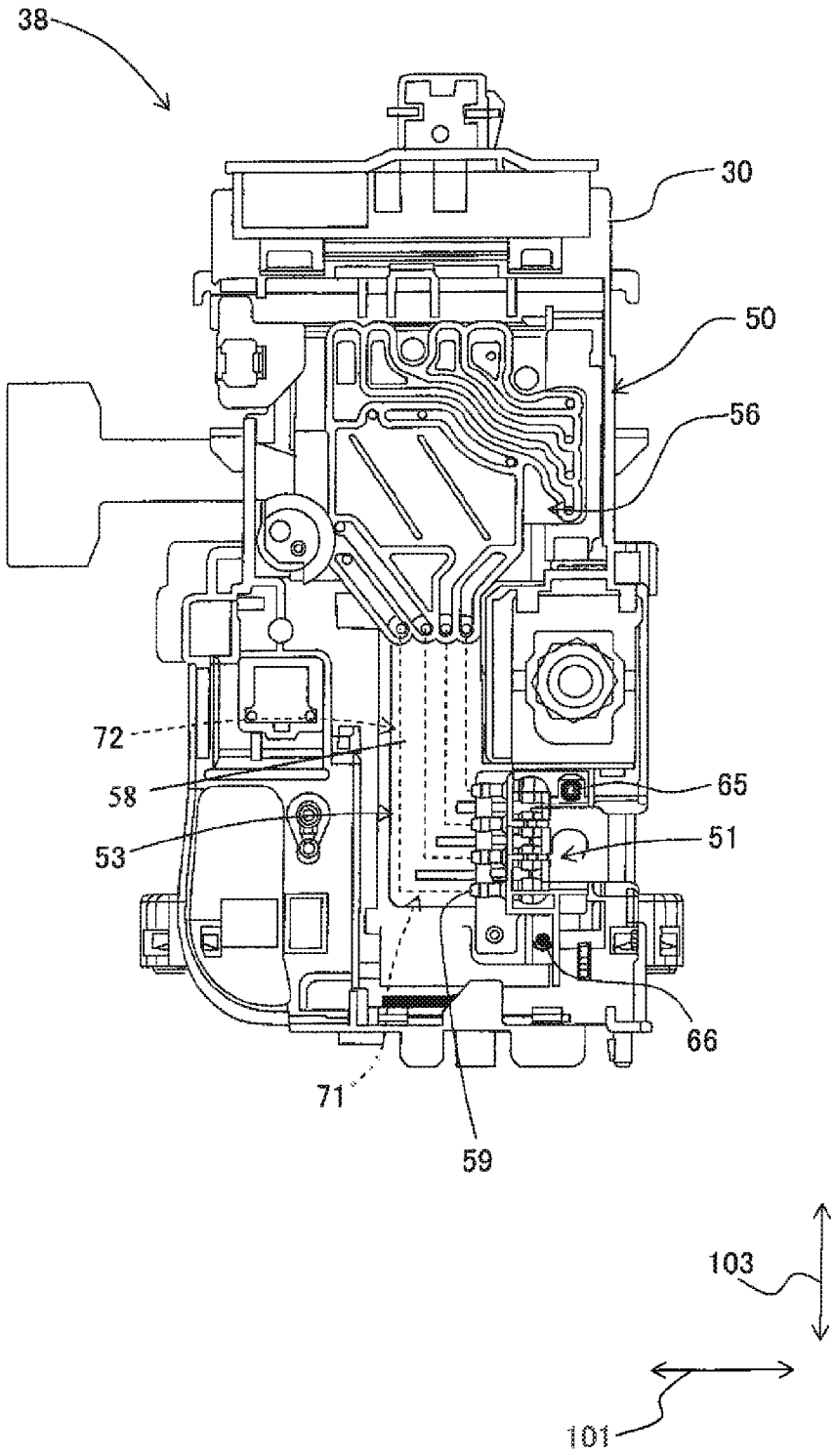
FIG. 7 is a plane view showing the carriage 38 in a state where the cover 31, a head control board 52, and a FFC 53 are detached.

In the channel section 55, four channels 58 are provided corresponding to the respective lead-in ports 57. As shown by dotted lines in FIG. 7, the respective channels 58 extend from the respective lead-in ports 57 in the width direction 101 to be bent perpendicularly and extend toward the tank section 56 in the depth direction 103. A portion of the respective channels 58 along the width direction 101 is referred to as a first portion 71 and a portion of the respective channels 58 along the depth direction 103 is referred to as a second portion 72. The depth direction 103 corresponds to a second direction in the present teaching. On an upper side of the channels 58, the FFC 53 extends in the depth direction 103 to overlap the second portion 72 mainly, and does not overlap most of the first portion 71. The lead-in ports 57 to be connected to the joint 51 are formed in a region, of the first portion 71, that does not overlap the FFC 53. Thus, the FFC 53 and the joint 51 can be disposed so as not to overlap vertically.

The tank section 56 is partitioned into four chambers corresponding to the four channels 58. The color inks can be independently stored in the chambers respectively. The inks can flow into the chambers from the channels 58 respectively. Further, the respective chambers of the tank section 56 are coupled to the recording head 39 so as to enable the respective color inks to flow, and the inks discharged from the respective chambers of the tank section 56 flow into the recording head 39, which is not shown in each of the drawings.

The channel member 50 is assembled in the carriage body 30 so that the channel section 55 and the tank section 56 are arranged in the depth direction 103. The channel section 55 is disposed on a guide rail 43 side that is the apparatus-front side, and the tank section 56 is disposed on a guide rail 44 side that is the apparatus-rear side.

In the carriage body 30, the joint 51 is disposed on an upper side of the channel section 55 of the channel member 50. The joint 51 has four openings (second connection portions) capable of connecting to the respective lead-in ports 57 of the channel member 50 formed in a lower surface of the joint 51, which are not shown in each of the drawings. The four openings formed in the lower surface of the joint 51 are aligned, and the joint 51 is a long member in a direction in which the openings are aligned. The joint 51 is assembled in the channel member 50 in a state where a longitudinal direction of the joint 51 is along the depth direction 103. On the channel member 50, two pins 65, 66 projecting upward are provided. The above pins 65, 66 are inserted into the joint 51, and thereby the joint 51 is positioned with respect to the channel member 50. Incidentally, a handle 51*a* for which a worker holds is provided on one end portion of the joint 51 in the longitudinal direction as described above. Thus, the worker can easily assemble the joint 51 in the channel member 50 by holding the handle 51*a*. Incidentally, the position, of the joint 51, where the handle 51*a* is provided is not limited to the one end portion in the longitudinal direction, and it is possible to provide the handle 51*a* at an arbitrary position as necessary.

Figure 6:
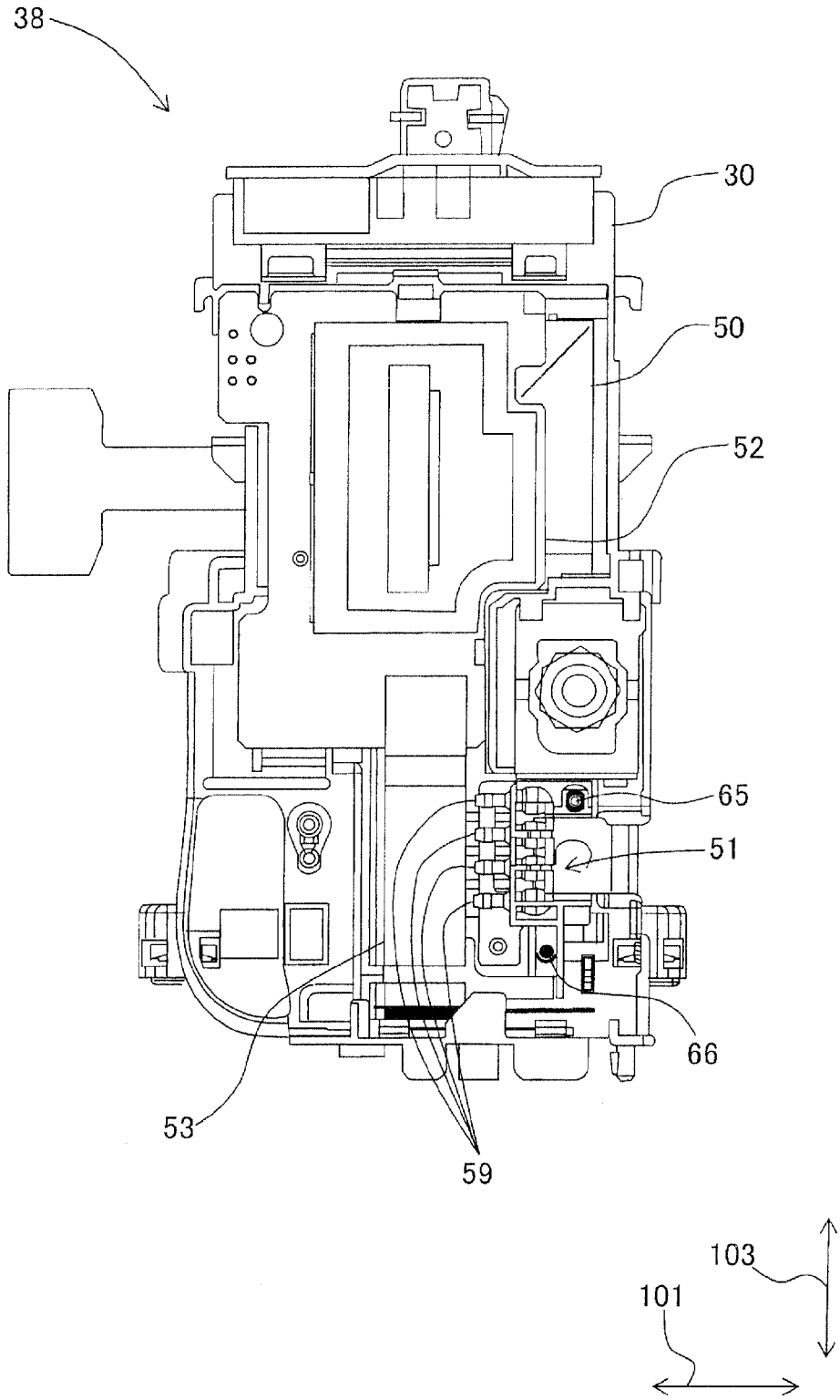
FIG. 6 is a plane view of the carriage 38 in a state where a cover 31 is removed.

As shown in FIG. 6, on an upper surface side of the joint 51, connection portions 59 (first connection portions) to be connected to the respective ink tubes 41 are provided. The four connection portions 59 are aligned corresponding to the four ink tubes 41. Each of the connection portions 59 has a cylindrical tube shape capable of being inserted into an inner space of each of the ink tubes 41. The connection portions 59 are each disposed so that an axis direction of each of the cylindrical tube shapes is coincident with the width direction 101. Further, the four connection portions 59 are aligned in the depth direction 103. The ink tubes 41 are connected to the connection portions 59 respectively, and thereby it is designed in a manner that the inks can flow into the recording head 39 from the ink tubes 41 through the channel member 50.

The joint 51, in a state of being assembled in the channel member 50, is stacked on an upper side of the first portion 71 of the channel section 55 in the channel member 50, but is not stacked on an upper side of the second portion 72. On the upper side of the second portion 72 of the channel section 55, the FFC 53 is disposed as will be described later. In other words, the joint 51 is disposed at a position that is on the upper side of the channel member 50 and on which the FFC 53 is not disposed. The ink tubes 41 connected to the joint 51 each extend from the apparatus-front side in the carriage 38 in the depth direction 103 along the width direction 101. The apparatus-front side in the carriage 38 in the depth direction 103 corresponds to one end side in the second direction intersecting with the first direction in the present teaching.

As shown in FIG. 6, the head control board 52 is disposed on an upper side of the tank section 56 of the channel member 50 in the carriage body 30. The head control board 52 is a board controlling the operation of the recording head 39 and is electrically connected to the recording head 39. The head control board 52 is such that various electronic elements are assembled on a printed circuit board, but explanations of a circuit configuration and the like of the head control board 52 are omitted here.

The head control board 52 is electrically connected to the previously described control board by the FFC 53. The control board controls the operation of the multifunction machine 10. The head control board 52 outputs an electric signal such as a drive signal in order to control the operation of the recording head 39 based on an electric signal output from the control board.

One end of the FFC 53 is electrically connected to an end portion of the head control board 52 on the apparatus-front side in the depth direction 103. The FFC 53 is linearly extended on the upper side of the channel section 55 of the channel member 50 and is extended to the outside from the apparatus-front side in the carriage 38 in the depth direction 103. At the apparatus-front side in the carriage 38 in the depth direction 103, the FFC 53 is appropriately bent to be extended in the same direction as that of the ink tubes 41, namely in the width direction 101.

The FFC 53 extends on the upper side of the second portion 72 along the depth direction 103 on the upper side of the channel section 55 of the channel member 50. Further, the FFC 53 is disposed on the upper side of the channel section 55 so that flat front and rear surfaces thereof become parallel to an upper surface of the channel section 55. Further, as described previously, the joint 51 is not disposed on the upper side of the second portion 72 in the channel section 55. In such a disposition, the FFC 53 is positioned lower than the connection portions 59 in the joint 51 in the height direction 102. Thus, the FFC 53 is disposed on the upper side of the channel section 55 of the channel member 50, and on an upper side of the FFC 53, the ink tubes 41 connected to the connection portions 59 are disposed.

<Test Printing>

Figure 8:
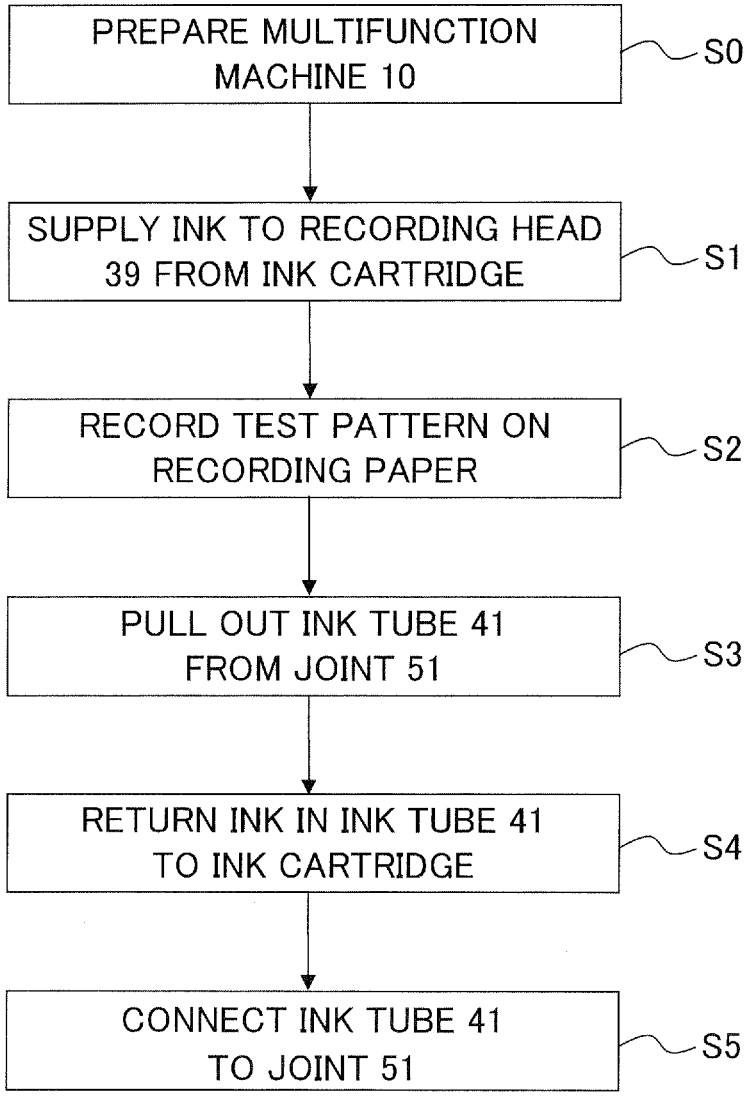
FIG. 8 is a flowchart explaining a test printing method according to the present invention.

The multifunction machine 10 is manufactured in a factory and then test printing is performed. The test printing is an inspection for determining whether the printer section 11 has a print quality in a predetermined standard. A test printing method will be explained with reference to FIG. 8. When the test printing is performed, the multifunction machine 10 is prepared (SO) and respective color ink cartridges are installed in the printer section 11. Respective color inks are supplied to the recording head 39 from the respective color ink cartridges through the ink tubes 41 and the channel member 50 (S1). The operation of the recording head 39 is controlled by the head control board 52. An electric signal is transmitted to the head control board 52 from the control board through the FFC 53. Ink droplets are selectively jetted onto a recording paper from the recording head 39 at a predetermined timing while the carriage 38 reciprocates (S2). The above ink droplets land on the recording paper, and thereby a test pattern is recorded on the recording paper.

After the test printing, the multifunction machine 10 determined to have a print quality in a predetermined standard is packed for shipment. When packing the multifunction machine 10, the inks remaining in the ink tubes 41 are also detached. Further, the ink cartridges in which the inks remain are removed from the printer section 11.

In order to remove the inks retained in the ink tubes 41, each of the ink tubes 41 is pulled out from the joint 51 (S3), and one end of each of the ink tubes 41 that are pulled out, namely the end connected to the joint 51 is held above the ink cartridge in a vertical direction, and thereby the ink in the ink tube 41 is retuned to the ink cartridge due to a head difference between the ink cartridge and the ink tube 41 (S4). As described above, the handle 51*a* is formed on the joint 51, so that the worker can easily detach the ink tubes 41 from the joint 51 while holding the joint 51.

As described previously, the ink tubes 41 are each disposed on the upper side of the FFC 53 in the carriage 38. Therefore, when the cover 31 of the carriage 38 is removed and each of the ink tubes 41 is detached from the joint 51 from the upper side in the vertical direction, the FFC 53 connected to the head control board 52 is not required to be detached from the carriage body 30.

After the inks in the ink tubes 41 are returned to the ink cartridges, the ink cartridges are removed from the printer section 11. Further, the ink tubes 41 are connected to the joint 51 again (S5), and the cover 31 is assembled in the carriage body 30.

As described above, the test printing method for the multifunction machine 10 may include the steps of: preparing the multifunction machine 10 of the present embodiment (S0); supplying the inks stored in the ink cartridges to the recording head 39 (S1); jetting the ink droplets onto the recording paper from the recording head 39 to perform a test printing on the recording paper (S2); opening one end of the ink tubes 41 by detaching the ink tubes 41 from the joint 51 or detaching the joint 51 from the channel member 50 (S3); holding the one end of the ink tubes 41 higher than the ink cartridges to return the ink in the ink tubes 41 to the ink cartridges (S4); and attaching the ink tubes 41, the joint 51, and the channel member 50 to communicate one another after the returning the ink in the ink tubes 41 to the ink cartridges.

In the carriage 38, the channel member 50, the FFC 53, and the ink tubes 41 are disposed in the order of the channel member 50, the cable, and the ink tubes 41 from a lower side to an upper side in the vertical direction, so that when the ink tubes 41 is detached from the joint 51 from the upper side in the vertical direction, the FFC 53 is not required to be detached from the carriage. This makes it easy to return the ink to the ink cartridges from the ink tubes 41 after the test printing. The ink supplied to the ink tubes 41 in the test printing is returned to the ink cartridges, so that the ink in the ink tubes 41 can be reused without being discarded, and ink leakage from the ink tubes 41 can be reduced after the test printing.

Incidentally, the work of removing the inks remaining in the ink tubes 41 as described above may be performed similarly also after test printing to be performed after the multifunction machine 10 is repaired. Incidentally, in the above-described test printing method, after the inks in the ink tubes 41 are returned to the ink cartridges, the ink cartridges are not necessarily removed from the printer section 11, and the ink cartridges may also remain attached to the printer section 11 as they are. Further, in the above-described test printing method, instead of detaching the ink tubes 41 from the joint 51, the joint 51 may also be detached from the channel member 50 in a state where the ink tubes 41 remain attached to the joint 51. In these cases, the ink tubes 41 are detached from the channel member 50 and the end portions of the ink tubes 41 on a joint 51 side are opened.

According to the above described embodiment, in the carriage 38, the channel member 50, the FFC 53, and the ink tubes 41 are disposed in the order of the channel member 50, the FFC 53, and the ink tubes 41 from the lower side to the upper side in the vertical direction, so that when the ink tubes 41 are detached from the joint 51 from the upper side in the vertical direction, the FFC 53 is not required to be detached from the carriage 38. This makes it easy to make the inks remaining in the ink tubes 41 flow into the ink cartridges after the test printing, and as a result, at the time of being stocked or transportation, dummy ink cartridges are not required to be used and ink leakage from the ink tubes 41 can be reduced. However, in the present teaching, it is not always necessary that dummy ink cartridges are not used at the time of being stocked or transportation. It may also be designed in a manner that the inks in the ink tubes 41 are returned to the ink cartridges, and then the ink cartridges are removed from the printer section 11 and dummy ink cartridges are attached to the printer section 11 in order to prevent small amounts of the inks remaining in the ink tubes 41 from leaking.

Further, since the joint 51 and the FFC 53 are disposed at the different positions in a plane view shown in FIG. 6, in the carriage 38, it is easy to attach/detach the ink tubes 41 to/from the joint 51 while the FFC 53 is being attached to the carriage 38.

Further, since the ink tubes 41 and the FFC 53 are extended from the same end side of the carriage 38 in the depth direction 103, the control board to be connected to the ink cartridges and the FFC 53 can be disposed at the same apparatus-front side. Further, since the channels 55 of the channel member 50 have the first portion 71 along the width direction 101 and the second portion 72 along the depth direction 103, even when the channel member 50 and the FFC 53 are stacked in the vertical direction, it is easy to dispose the joint 51 and the FFC 53 at the different positions in a plane view shown in FIG. 6.

Further, since the four ink tubes 41 are arranged along the depth direction 103 to be connected to the joint 51, an extra space is created in the vertical direction (height direction 102) perpendicular to the width direction 101 and the depth direction 103, and resulting that an apparatus height in the vicinity of the carriage 38 can be reduced.

What is claimed is:

1. An image recording apparatus which jets droplets of an ink onto a recording medium, comprising:

a recording head having a plurality of nozzles through which the ink droplets are jetted;

an ink storage section which stores the ink;

a tube of which one end is connected to the ink storage section and through which the ink to be supplied to the recording head from the ink storage section flows;

a channel member in which an ink channel that communicates with the recording head is formed;

a joint which is detachably attached to the channel member which connects the other end of the tube and the ink channel of the channel member to flow the ink therebetween;

a circuit board which is mounted on the recording head; and a cable which is electrically connected to the circuit board, wherein the channel member, the cable, and the tube are disposed in a fixed order of the channel member, the cable, and the tube from a lower side to an upper side in a direction of gravitational force, and the tube is arranged to overlap with the cable at the other end of the tube to which the joint is connected.

2. The image recording apparatus according to claim 1, wherein the joint is disposed on a region where the cable is not disposed.

3. The image recording apparatus according to claim 2, wherein the tube and the cable are extended from one side in a second direction intersecting with a first direction, and the channel in the channel member has a first portion extending in the first direction and a second portion extending in the second direction.

4. The image recording apparatus according to claim 3, wherein the first portion of the channel and the second portion of the channel is formed in an L shape.

5. The image recording apparatus according to claim 3, wherein the ink storage section includes a plurality of individual ink storage sections, the tube includes a plurality of individual tubes corresponding to the individual ink storage sections, and first connection portions, which are arranged in the second direction and to which the respective individual tubes are connected, are formed on the joint.

6. The image recording apparatus according to claim 1, wherein the joint has a first connection portion connected to the tube, a second connection portion connected to the channel member, and a handle.

7. The image recording apparatus according to claim 3, wherein the cable extends in the second direction above the channel member, the first portion of the channel in the channel member has a non-overlapping region which does not overlap the cable, and the joint is disposed on the non-overlapping region of the first portion.

* * * * *